US008917217B2

(12) United States Patent
Sze et al.

(10) Patent No.: US 8,917,217 B2
(45) Date of Patent: Dec. 23, 2014

(54) BROADBAND CIRCULARLY POLARIZED ANNULAR RING SLOT ANTENNA

(75) Inventors: Jia-Yi Sze, Taoyuan (TW); Wei-Hung Chen, Taipei (TW)

(73) Assignee: National Defense University, Bade (TW)

( * ) Notice: Subject to any disclaimer, the term of this patent is extended or adjusted under 35 U.S.C. 154(b) by 1035 days.

(21) Appl. No.: 12/926,504

(22) Filed: Nov. 23, 2010

(65) Prior Publication Data

US 2011/0134006 A1 Jun. 9, 2011

(30) Foreign Application Priority Data

Dec. 8, 2009 (TW) ..... 98141856 A

(51) Int. Cl.
*H01Q 13/10* (2006.01)
*H01Q 1/38* (2006.01)

(52) U.S. Cl.
CPC ..... *H01Q 13/106* (2013.01); *H01Q 1/38* (2013.01)
USPC ..... 343/769; 343/700 MS

(58) Field of Classification Search
CPC ..... H01Q 13/106
USPC ..... 363/769; 343/769
See application file for complete search history.

(56) References Cited

U.S. PATENT DOCUMENTS 8,368,596 B2 * 2/2013 Tiezzi et al. ..... 343/700 MS
2007/0115193 A1 * 5/2007 Minard et al. ..... 343/769

* cited by examiner

*Primary Examiner* — Michael C Wimer
*Assistant Examiner* — Michael Bouizza
(74) *Attorney, Agent, or Firm* — Bacon & Thomas, PLLC

(57) ABSTRACT

A broadband circularly polarized annular ring slot antenna is disclosed, which includes a substrate, an annular ring slot antenna portion located on the upper surface of the substrate, and a microstrip feeding portion located on the lower surface of the substrate. The annular ring slot antenna portion includes a grounding unit, an annular ring slot unit, a central metal unit, a first perturbation metal unit and a second perturbation metal unit. The first perturbation metal unit and the second perturbation metal unit are extended from the grounding unit, towards the central metal unit, respectively. The microstrip feeding portion includes a vertical feeding unit, a bent feeding unit and a rectangular microstrip unit.

7 Claims, 7 Drawing Sheets

BROADBAND CIRCULARLY POLARIZED ANNULAR RING SLOT ANTENNA

BACKGROUND OF THE INVENTION

1. Field of the Invention

The invention relates to a broadband circularly polarized annular ring slot antenna and, more particularly, to a broadband circularly polarized annular ring slot antenna for increasing the 3-dB-axial-ratio bandwidth without increasing the antenna size.

2. Description of Related Art

Circularly polarized (CP) antennas, known for their capabilities of reducing polarization mismatch and moderately suppressing multipath interferences, require larger bandwidths of greater than 30% to support emerging wireless-communication applications, especially those involving satellite communications. Because of the advantages of large impedance bandwidths and low profiles, printed slot antennas have received much attention in antenna design requiring enhanced 3-dB axial-ratio bandwidths.

As shown in FIGS. 1A and 1B, the conventional broadband circularly polarized annular ring slot antenna includes: a substrate 11, an annular ring slot antenna portion 12 and a microstrip feeding portion 13, wherein the annular ring slot antenna portion 12 is located on the upper surface 111 of the substrate 11, and the microstrip feeding portion 13 is located on the lower surface 112 of the substrate 11. Besides, as shown in FIG. 1A, the annular ring slot antenna portion 12 includes a grounding unit 121, an annular ring slot unit 122, a central metal unit 123 and a coupling slot unit 124. The coupling slot unit 124 is extended from a side edge of the annular ring slot unit 122. The annular ring slot unit 122 and the coupling slot unit 124 are both surrounded by the grounding unit 121. The central metal unit 123 is surrounded by the annular ring slot unit 122.

With reference to FIG. 1A, the microstrip feeding portion 13 includes a first vertical feeding unit 131, a second vertical feeding unit 132 and a rectangular microstrip unit 133. The rectangular microstrip unit 133 is connected with the first vertical feeding unit 131 and the second vertical feeding unit 132 respectively. Besides, the first vertical feeding unit 131 is extended from the rectangular microstrip unit 133 toward a side edge 113 of the substrate 11, and the second vertical feeding unit 132 is extended from the rectangular microstrip unit 133 in the direction departing from the first vertical feeding unit 131. Moreover, the rectangular microstrip unit 133 of the microstrip feeding portion 13 corresponds to the coupling slot unit 124 of the annular ring slot antenna portion 12.

In practical measurement, the 3-dB-axial-ratio bandwidth of the conventional broadband circularly polarized annular ring slot antenna is only between 3.5% and 11%, which is far below the aforementioned standard (i.e. large than 32%). Therefore, it is desired to have a significant improvement on the circular polarization performance of the conventional circularly polarized annular ring slot antenna. However, in order to improve the 3-dB-axial-ratio bandwidth of the conventional broadband circularly polarized annular ring slot antenna, not only the size of the annular ring slot unit and the grounding unit of the conventional broadband circularly polarized annular ring slot antenna have to be enlarged, but also the slot width of the annular ring slot unit of the annular ring slot antenna portion needs to be enlarged for forming the so-called wide-slot type ring slot unit. Accordingly, the whole size of the conventional broadband circularly polarized annular ring slot antenna is inevitably to be greatly increased.

SUMMARY OF THE INVENTION

The primary object of the present invention is to propose a broadband circularly polarized annular ring slot antenna, which is capable of increasing the 3-dB-axial-ratio bandwidth of larger than 32% without increasing the antenna size.

Another object of the present invention is to propose a broadband circularly polarized annular ring slot antenna which can be applied in many L-band Global Navigation Satellite Systems including the Global Positioning System (GPS) of the U.S.A., the Global Navigation Satellite System (GLNASS) of the Russia and the Galileo Positioning System of the Europe, whose operating bands range from 1164 MHz to 1610 MHz.

To achieve these objects, a broadband circularly polarized annular ring slot antenna is proposed, comprising: a substrate, having an upper surface and a lower surface; an annular ring slot antenna portion, located on the upper surface and including a grounding unit, an annular ring slot unit, a central metal unit, a first perturbation metal unit and a second perturbation metal unit, the annular ring slot unit being surrounded by the grounding unit, the central metal unit being surrounded by the annular ring slot unit; and a microstrip feeding portion, located on the lower surface and including a vertical feeding unit, a bent feeding unit and a rectangular microstrip unit, the rectangular microstrip unit being connected with the bent feeding unit and the vertical feeding unit respectively, the vertical feeding unit being extended from the bent feeding unit toward a side edge of the substrate, the bent feeding unit being extended from the vertical feeding unit toward another side edge of the substrate; wherein the first perturbation metal unit and the second perturbation metal unit of the annular ring slot antenna portion are extended from the grounding unit toward the central metal unit respectively, and the first perturbation metal unit and the second perturbation metal unit are implanted diametrically opposite with respect to the central metal unit in the annular ring slot unit.

Since the annular ring slot antenna portion includes the first perturbation metal unit and the second perturbation metal unit, which are implanted diametrically opposite with respect to the central metal unit in the annular ring slot unit, and the microstrip feeding portion includes a bent feeding unit, a vertical feeding unit, and a rectangular microstrip unit connected with both the bent feeding unit and the vertical feeding unit, the 3-dB-axial-ratio bandwidth of the broadband circularly polarized annular ring slot antenna of the present invention is much larger than that of the conventional broadband circularly polarized annular ring slot antenna (larger than 32%). Besides, by properly adjusting the material of the substrate and the size of each component (while the shape and the relative relationship of each component are fixed), the broadband circularly polarized annular ring slot antenna of the present invention can be also operated in L band (1~0.2 GHz).

DETAILED DESCRIPTION OF THE PREFERRED EMBODIMENT

Figure 1A:
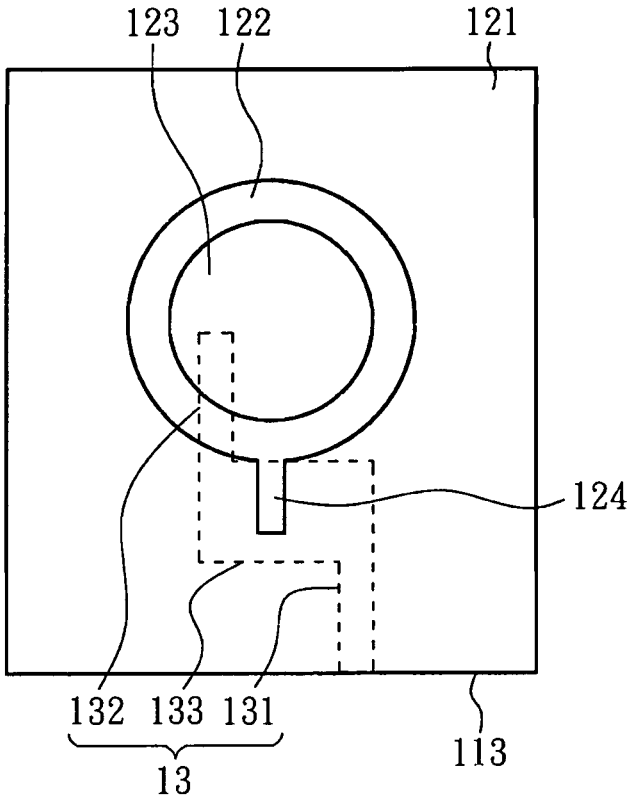
FIG. 1A is a schematic diagram of the annular ring slot antenna portion of the conventional broadband circularly polarized annular ring slot antenna.
Figure 1B:
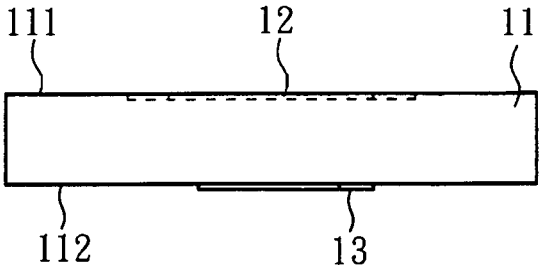
FIG. 1B is a side view diagram of the conventional broadband circularly polarized annular ring slot antenna.
Figure 2A:
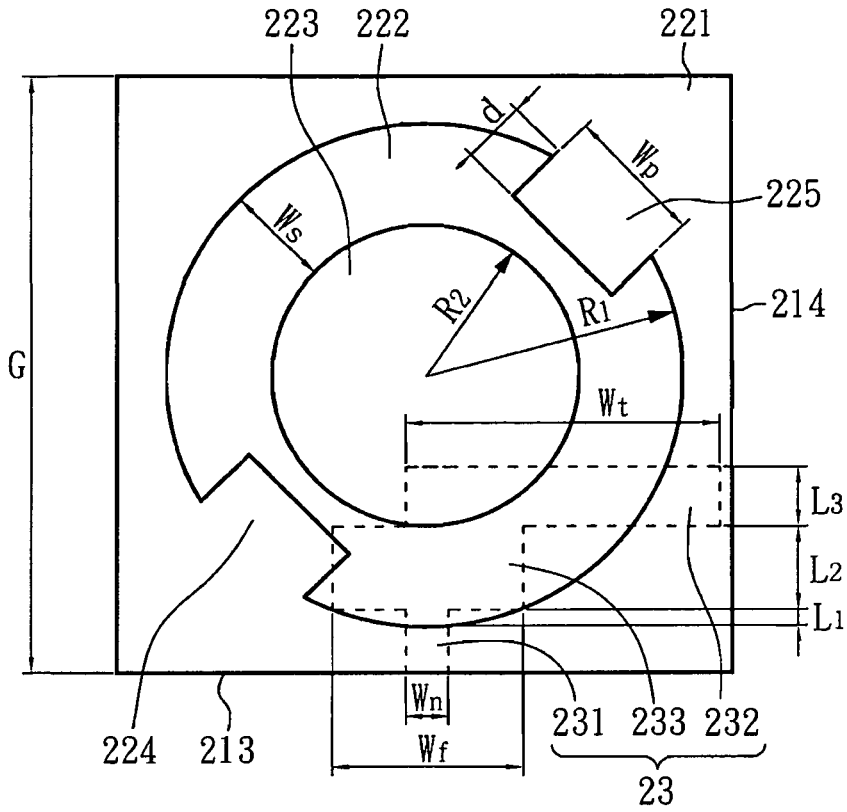
FIG. 2A is a schematic diagram of the annular ring slot antenna portion of the broadband circularly polarized annular ring slot antenna according to the first embodiment of the present invention.
Figure 2B:
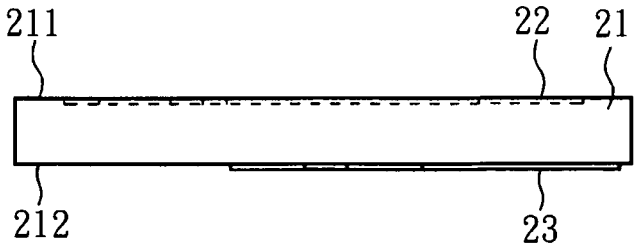
FIG. 2B is a side view diagram of the broadband circularly polarized annular ring slot antenna according to the first embodiment of the present invention.

As shown in FIGS. 2A and 2B, the broadband circularly polarized annular ring slot antenna according to the first embodiment of the present invention comprises: a substrate 21, an annular ring slot antenna portion 22 and a microstrip feeding portion 23, in which the annular ring slot antenna portion 22 is located on the upper surface 211 of the substrate 21, and the microstrip feeding portion 23 is located on the lower surface 212 of the substrate 21. As shown in FIG. 2A, the annular ring slot antenna portion 22 includes a grounding unit 221, an annular ring slot unit 222, a central metal unit 223, a first perturbation metal unit 224 and a second perturbation metal unit 225. The annular ring slot unit 222 is surrounded by the grounding unit 221. The central metal unit 223 is surrounded by the annular ring slot unit 222. The first perturbation metal unit 224 and the second perturbation metal unit 225 are extended from the grounding unit 221, toward the central metal unit 223, respectively. Furthermore, the first perturbation metal unit 224 and the second perturbation metal unit 225 are implanted in the annular ring slot unit 222 diametrically opposite with respect to the central metal unit 223.

With reference to FIG. 2A, the microstrip feeding portion 23 includes a vertical feeding unit 231, a bent feeding unit 232 and a rectangular microstrip unit 233. The rectangular microstrip unit 233 is connected with the bent feeding unit 232 and the vertical feeding unit 231, respectively. The vertical feeding unit 231 is extended from the bent feeding unit 232 toward a side edge 213 of the substrate 21, while the bent feeding unit 232 is extended from the vertical feeding unit 231 toward another side edge 214 of the substrate 21.

In this embodiment, the substrate 21 is a rectangular substrate made of a material with a low dielectric constant, such as the FR4 material. The grounding unit 221, the central metal unit 223, the first perturbation metal unit 224 and the second perturbation metal unit 225 are all thin layer copper films with thickness of 0.02 mm, but they also can be thin layer metal films made of other material, such as gold foil, silver foil or aluminum foil. The annular ring slot unit 222 of the annular ring slot antenna portion 22 has a shape of annular ring, and the central metal unit 223 has a shape of circle. Moreover, the centers of the annular ring slot unit 222 and the central metal unit 223 are overlapped. The first perturbation metal unit 224 and the second perturbation metal unit 225 are rectangular patches located on a diagonal line (not shown) of the substrate 21, respectively.

The first perturbation metal unit 224 and the second perturbation metal unit 225 of the annular ring slot antenna portion 22 are located on the diagonal line (not shown) of the substrate 21 and extended from the junction of the diagonal line (not shown) of the substrate 21 and the grounding unit 221, toward the central metal unit 223, respectively. The first perturbation metal unit 224 and the second perturbation metal unit 225 are implanted in the in the annular ring slot unit 222 diametrically opposite with respect to the central metal unit 223. Besides, the angle between the diagonal line and the extending direction of the vertical feeding unit 231 is 45 degrees.

Moreover, the annular ring slot unit 222 has an outer radius $R_1$, an inner radius $R_2$, a slot width $W_s$ and an average radius. The slot width $W_s$ is the difference between the outer radius $R_1$ and the inner radius $R_2$. The average radius is the average value of the outer radius $R_1$ and the inner radius $R_2$. For showing the sizes of the substrate 21, the annular ring slot antenna portion 22 and the microstrip feeding portion 23 of the broadband circularly polarized annular ring slot antenna according to the first embodiment of the present invention, values of the labels shown in FIG. 2A are listed in the following Table 1:

TABLE 1

| | | | | | |
|---|---|---|---|---|---|
| Label | G | $R_1$ | $R_2$ | $W_s$ | $W_p$ |
| Size (mm) | 45 | 17.5 | 10.5 | 7 | 10 |
| Label | d | $W_n$ | $W_f$ | $W_t$ | $L_1$ |
| Size (mm) | 4 | 15 | 1.5 | 23 | 1 |
| Label | $L_2$ | $L_3$ | | | |
| Size (mm) | 6 | 2 | | | |

Figure 3A:
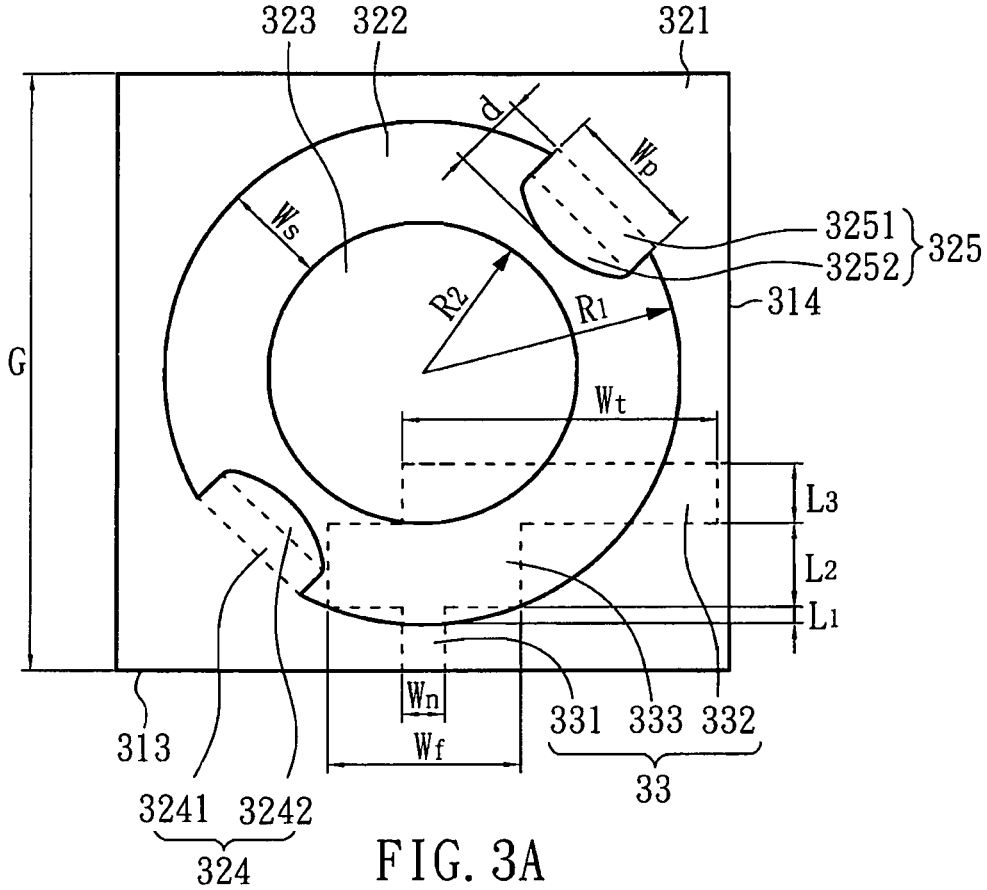
FIG. 3A is a schematic diagram of the annular ring slot antenna portion of the broadband circularly polarized annular ring slot antenna according to the second embodiment of the present invention.
Figure 3B:
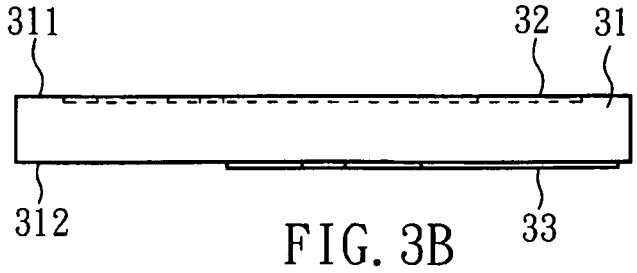
FIG. 3B is a side view diagram of the broadband circularly polarized annular ring slot antenna according to the second embodiment of the present invention.

As shown in FIGS. 3A and 3B, the broadband circularly polarized annular ring slot antenna according to the second embodiment of the present invention comprises: a substrate 31, an annular ring slot antenna portion 32 and a microstrip feeding portion 33, in which the annular ring slot antenna portion 32 is located on the upper surface 311 of the substrate 31, and the microstrip feeding portion 33 is located on the lower surface 312 of the substrate 31. As shown in FIG. 3A, the annular ring slot antenna portion 32 includes a grounding unit 321, an annular ring slot unit 322, a central metal unit 323, a first perturbation metal unit 324 and a second perturbation metal unit 325. The annular ring slot unit 322 is surrounded by the grounding unit 321. The central metal unit 323 is surrounded by the annular ring slot unit 322. The first perturbation metal unit 324 and the second perturbation metal unit 325 of the annular ring slot antenna portion 32 are extended from the grounding unit 321, toward the central metal unit 323, respectively. The first perturbation metal unit 324 and the second perturbation metal unit 325 are implanted in the annular ring slot unit 32 diametrically opposite with respect to the central metal unit 323.

With reference to FIG. 3A, the microstrip feeding portion 33 includes a vertical feeding unit 331, a bent feeding unit 332 and a rectangular microstrip unit 333. The rectangular microstrip unit 333 is connected with the bent feeding unit 332 and the vertical feeding unit 331, respectively. The vertical feeding unit 331 is extended from the bent feeding unit 332 toward a side edge 313 of the substrate 31, while the bent feeding unit 332 is extended from the vertical feeding unit 331 toward another side edge 314 of the substrate 31.

In this embodiment, the substrate 31 is a rectangular substrate made of a material with a low dielectric constant, such as the FR4 material. The grounding unit 321, the central metal unit 323, the first perturbation metal unit 324 and the second perturbation metal unit 325 are all thin layer copper films with thickness of 0.02 mm, but they also can be thin layer metal films made of other material, such as gold foil, silver foil or aluminum foil. The annular ring slot unit 322 of the annular ring slot antenna portion 32 has a shape of annular ring, and the central metal unit 323 has a shape of circle. Moreover, the centers of the annular ring slot unit 322 and the central metal unit 323 are overlapped. The first perturbation metal unit 324 and the second perturbation metal unit 325 are located on a diagonal line (not shown) of the substrate 31, respectively.

As shown in FIG. 3A, the first perturbation metal unit 324 is composed of a first rectangular patch 3241 and a first semi-elliptical patch 3242. The first semi-elliptical patch 3242 is extended from the first rectangular patch 3241 toward the central metal unit 323. The length and the width of the first rectangular patch 3241 are $W_p$ and 0.5d, respectively. The major axis and the minor axis of the first semi-elliptical patch 3242 are $W_p$ and d, respectively. The second perturbation metal unit 325 is composed of a second rectangular patch 3251 and a second semi-elliptical patch 3252, wherein the second semi-elliptical patch 3252 is extended from the second rectangular patch 3251 toward the central metal unit 323. The length and the width of the second rectangular patch 3251 are $W_p$ and 0.5d, respectively. The major axis and the minor axis of the second semi-elliptical patch 3252 are $W_p$ and d, respectively.

As shown in FIG. 3A, the first perturbation metal unit 324 and the second perturbation metal unit 325 of the annular ring slot antenna portion 32 are located on the diagonal line (not shown) of the substrate 31 and extended from the junction of the diagonal line (not shown) of the substrate 31 and the grounding unit 321, toward the central metal unit 323, respectively. The first perturbation metal unit 324 and the second perturbation metal unit 325 are implanted in the in the annular ring slot unit 222 diametrically opposite with respect to the central metal unit 323. Besides, the angle between the diagonal line and the extending direction of the vertical feeding unit 331 is 45 degrees.

In addition, the annular ring slot unit 322 has an outer radius $R_1$, an inner radius $R_2$, a slot width $W_s$ and an average radius. For showing the sizes of the substrate 31, the annular ring slot antenna portion 32 and the microstrip feeding portion 33 of the broadband circularly polarized annular ring slot antenna according to the second embodiment of the present invention, values of the labels shown in FIG. 3A are listed in the following Table 2:

TABLE 2

| | | | | | |
|---|---|---|---|---|---|
| Label | G | $R_1$ | $R_2$ | $W_s$ | $W_p$ |
| Size (mm) | 45 | 17.5 | 10.5 | 7 | 10 |
| Label | d | $W_n$ | $W_f$ | $W_t$ | $L_1$ |
| Size (mm) | 4 | 15 | 1.5 | 23 | 1 |
| Label | $L_2$ | $L_3$ | | | |
| Size (mm) | 6 | 2 | | | |

Figure 4A:
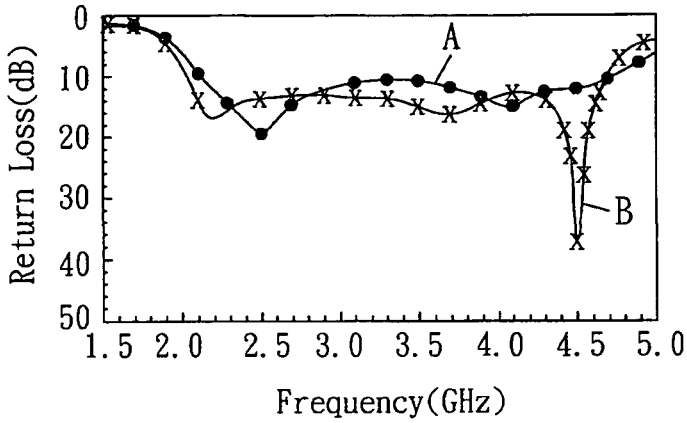
FIG. 4A plots curves of the simulated return losses against frequency for the broadband circularly polarized annular ring slot antennas, according to the first and the second embodiments of the present invention.
Figure 4B:
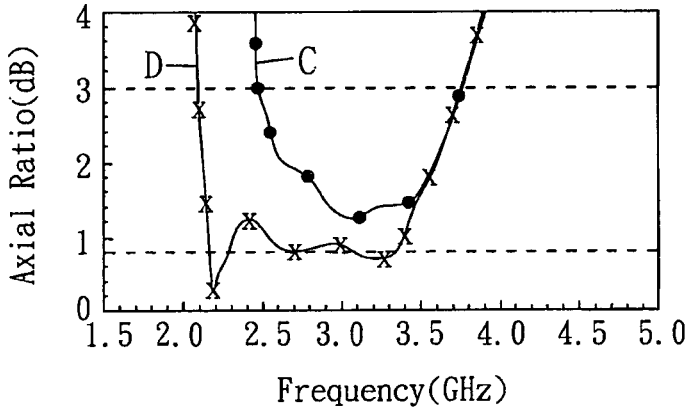
FIG. 4B plots the curves of the simulated axial ratios against frequency for the broadband circularly polarized annular ring slot antennas, according to the first and the second embodiments of the present invention.
Figure 4C:
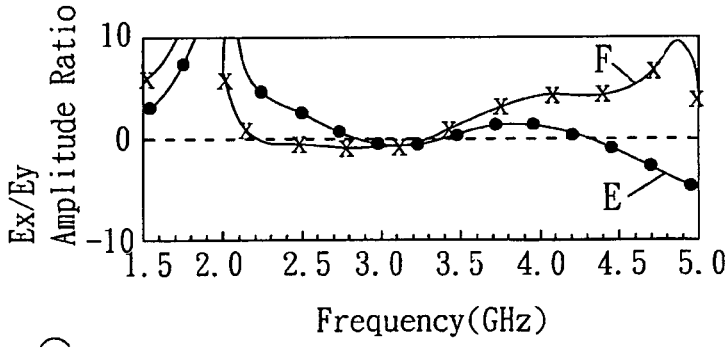
FIG. 4C plots the curves of the simulated amplitude ratios of two orthogonal electric fields $E_X$ and $E_Y$ in far field against frequency for the broadband circularly polarized annular ring slot antennas, according to the first and the second embodiments of the present invention.
Figure 4D:
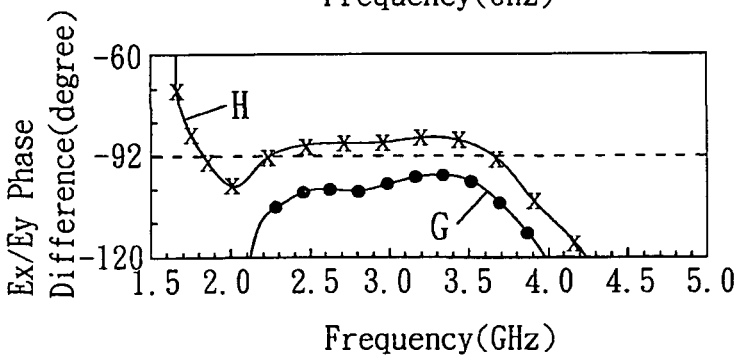
FIG. 4D plots the curves of the simulated phase differences of two orthogonal electric fields $E_X$ and $E_Y$ in far field against frequency for the broadband circularly polarized annular ring slot antennas, according to the first and the second embodiments of the present invention.

Please refer to FIGS. 4A to 4D, wherein FIG. 4A plots curves of the simulated return losses against frequency for the broadband circularly polarized annular ring slot antennas, according to the first and the second embodiments of the present invention. FIG. 4B plots the curves of the simulated axial ratios against frequency for the broadband circularly polarized annular ring slot antennas, according to the first and the second embodiments of the present invention. FIG. 4C plots the curves of the simulated amplitude ratios of two orthogonal electric fields $E_X$ and $E_Y$ in far field against frequency for the broadband circularly polarized annular ring slot antennas, according to the first and the second embodiments of the present invention. FIG. 4D plots the curves of the simulated phase differences of two orthogonal electric fields $E_X$ and $E_Y$ in far field against frequency for the broadband circularly polarized annular ring slot antennas, according to the first and the second embodiments of the present invention.

The simulation result of the aforementioned FIGS. 4A to 4D are obtained by using the Ansoft High Frequency Structure Simulator. In FIG. 4A, the curves A and B represent the return losses of the broadband circularly polarized annular ring slot antenna according to the first and second embodiments of the present invention, respectively. In FIG. 4B, the curves C and D represent the axial ratios of the broadband circularly polarized annular ring slot antenna according to the first and second embodiments of the present invention, respectively.

In FIG. 4C, the curves E and F represent the amplitude ratios of two orthogonal electric fields $E_X$ and $E_Y$ in far field of the broadband circularly polarized annular ring slot antenna according to the first and second embodiments of the present invention, respectively. In FIG. 4D, the curves G and H represent the phase differences of two orthogonal electric fields $E_X$ and $E_Y$ in far field of the broadband circularly polarized annular ring slot antenna according to the first and second embodiments of the present invention, respectively.

From FIGS. 4A and 4B, it can be seen that the circularly polarized frequency band of the broadband circularly polarized annular ring slot antenna according to the first embodiment of the present invention is located between 2460 MHz and 3740 MHz, which means that a 3-dB-axial-ratio bandwidth of 41.3% is achieved. Furthermore, the circularly polarized frequency band of the broadband circularly polarized annular ring slot antenna according to the second embodiment of the present invention is located between 2100 MHz and 3740 MHz, which means that a 3-dB-axial-ratio bandwidth of 56.2% is achieved. Therefore, the broadband circularly polarized annular ring slot antennas according to the first and the second embodiments of the present invention both provide a 3-dB-axial-ratio bandwidth of greater than 32%.

Moreover, from FIGS. 4C and 4D, it can be seen that the 3-dB-axial-ratio bandwidth provided by the broadband circularly polarized annular ring slot antenna according to the second embodiment of the present invention is greater than one according to the first embodiment of the present invention. This is because that the first and the second embodiments of the present invention have different structures of perturbation metal unit. Namely, the original rectangular patches (i.e. the first perturbation metal unit 224 and the second perturbation metal unit 225) are deformed into a composition of a rectangular patch and a semi-elliptical patch (i.e. the first perturbation metal unit 324 and the second perturbation metal unit 325). Thus, due to the deformed composition structure, the phase difference of $E_X$ and $E_Y$ of the broadband circularly polarized annular ring slot antenna according to the second embodiment of the present invention increase from −100 degrees or below to −90 degrees, within the range from 2100 MHz to 3740 MHz. Besides, the lower-end frequency having the amplitude ratio of $E_X$ and $E_Y$ close to 0 dB is extended downwardly to about 2100 MHz.

Figure 5A:
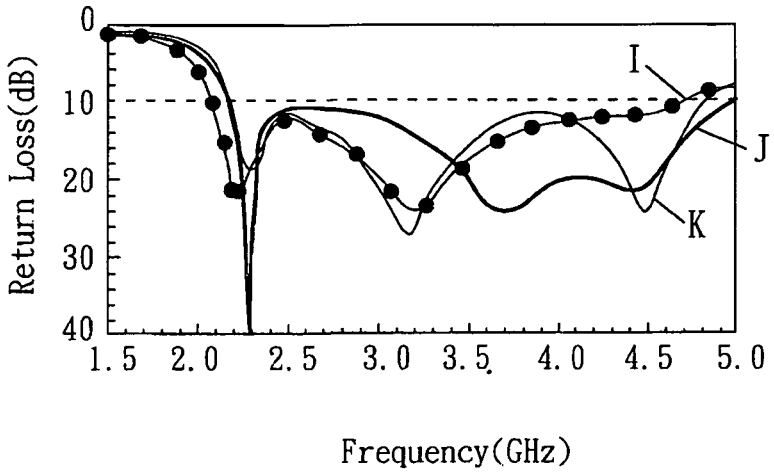
FIG. 5A shows the curves of return losses against frequency for the broadband circularly polarized annular ring slot antennas, according to the second embodiment of the present invention, while the slot width of the annular ring slot unit of the annular ring slot antenna portion is varied.
Figure 5B:
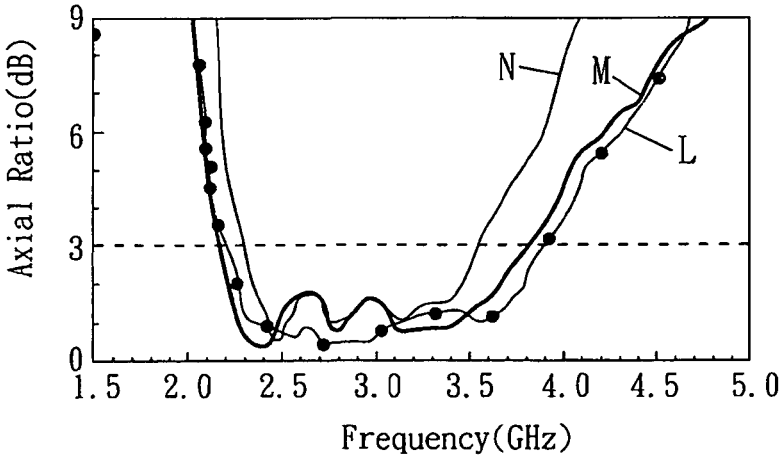
FIG. 5B shows the curves of axial ratios against frequency for the broadband circularly polarized annular ring slot antennas, according to the second embodiment of the present invention, while the slot width of the annular ring slot unit of the annular ring slot antenna portion is varied.

Please refer to FIGS. 5A and 5B, wherein FIG. 5A shows the curves of return losses against frequency for the broadband circularly polarized annular ring slot antennas, according to the second embodiment of the present invention, while the slot width of the annular ring slot unit of the annular ring slot antenna portion is varied. FIG. 5B shows the curves of axial ratios against frequency for the broadband circularly polarized annular ring slot antennas, according to the second embodiment of the present invention, while the slot width of the annular ring slot unit of the annular ring slot antenna portion is varied.

In FIG. 5A, the curves I, J, and K represent the return losses of the broadband circularly polarized annular ring slot antenna according to the second embodiment of the present invention, while the slot widths of the annular ring slot unit is 9 mm, 7 mm and 5 mm, respectively.

In FIG. 5B, the curves L M, and N represent the axial ratios of the broadband circularly polarized annular ring slot antenna according to the second embodiment of the present invention, while the slot width of the annular ring slot unit is 9 mm, 7 mm, and 5 mm.

The size and the antenna characteristics of these three kinds of broadband circularly polarized annular ring slot antennas according to the second embodiment of the present invention are listed in the following Table 3:

TABLE 3

| slot width (mm) | $R_1$ (mm) | $R_2$ (mm) | d (mm) | $L_2$ (mm) | $W_n$ (mm) | 3 dB circularly polarized frequency band (MHz) | 3-dB-axial-ratio bandwidth (%) |
|---|---|---|---|---|---|---|---|
| 9 | 18.5 | 9.5 | 6 | 8 | 14 | 2175-3900 | 56.8 |
| 7 | 17.5 | 10.5 | 4 | 6 | 15 | 2175-3800 | 54.4 |
| 5 | 16.5 | 11.5 | 2 | 4 | 15 | 2325-3525 | 41 |

The parameters and associated values of these three kinds of broadband circularly polarized annular ring slot antennas having annular ring slot units of different slot widths according to the second embodiment of the present invention are listed as follow:

$\in_r$=4.4, tan δ=0.02, h=0.8 mm, G=45 mm, $w_f$=1.5 mm, L1=1 mm, L3=2 mm, $w_t$=23 mm, $w_p$=10 mm.

It can be seen from Table 3 that, with the average radius (14 mm), the 3-dB-axial-ratio bandwidths of these three kinds of broadband circularly polarized annular ring slot antennas according to the second embodiment of the present invention are all of greater than 32%. Moreover, the wider the slot width is, the greater the bandwidth of the circularly polarized frequency band is, and the maximum of the 3-dB-axial-ratio bandwidth can be up to 56.8%.

In order to apply in L-band Satellite System, especially in Global Navigation Satellite Systems whose operating frequency bands ranges from 1164 MHz to 1610 MHz, the broadband circularly polarized annular ring slot antennas according to the third and the fourth embodiments of the present invention are provided. The shape of each component and the relative relationship of each component of the broadband circularly polarized annular ring slot antennas according to the third and the fourth embodiments of the present invention are all the same as those according to the second embodiment shown in FIG. 3. However, the size of each component and the material of the substrate of the broadband circularly polarized annular ring slot antennas according to the third and the fourth embodiments of the present invention are different from those according to the second embodiment shown in FIG. 3.

Besides, in the broadband circularly polarized annular ring slot antennas according to the third embodiment of the present invention, the substrate is a rectangular substrate made of a material with a low dielectric constant, such as the FR4 material (with characteristic parameters of $\in_r$=4.4, tan δ=0.02, h=0.8 mm). The values of the labels used for showing the sizes of components (i.e. the substrate, the annular ring slot antenna portion and the microstrip feeding portion) of the broadband circularly polarized annular ring slot antenna according to the third embodiment of the present invention are listed in the following Table 4:

TABLE 4

| | | | | | |
|---|---|---|---|---|---|
| Label | G | $R_1$ | $R_2$ | $W_s$ | $W_p$ |
| Size (mm) | 90 | 35 | 21 | 14 | 22 |
| Label | d | $W_n$ | $W_f$ | $W_t$ | $L_1$ |
| Size (mm) | 9 | 27 | 1.5 | 45 | 2 |
| Label | $L_2$ | $L_3$ | | | |
| Size (mm) | 12 | 4 | | | |

In addition, in the broadband circularly polarized annular ring slot antennas according to the fourth embodiment of the present invention, the substrate is a rectangular substrate made of the RT5880 material (with characteristic parameters of $\in_r$=2.2, tan δ=0.0009, h=0.6 mm). The values of the labels used for showing the sizes of components (i.e. the substrate, the annular ring slot antenna portion and the microstrip feeding portion) of the broadband circularly polarized annular ring slot antenna according to the fourth embodiment of the present invention are listed in the following Table 5:

TABLE 5

| | | | | | |
|---|---|---|---|---|---|
| Label | G | $R_1$ | $R_2$ | $W_s$ | $W_p$ |
| Size (mm) | 100 | 40 | 24 | 16 | 23 |
| Label | d | $W_n$ | $W_f$ | $W_t$ | $L_1$ |
| Size (mm) | 9 | 34 | 1.8 | 50 | 2 |
| Label | $L_2$ | $L_3$ | | | |
| Size (mm) | 14 | 4 | | | |

Figure 6A:
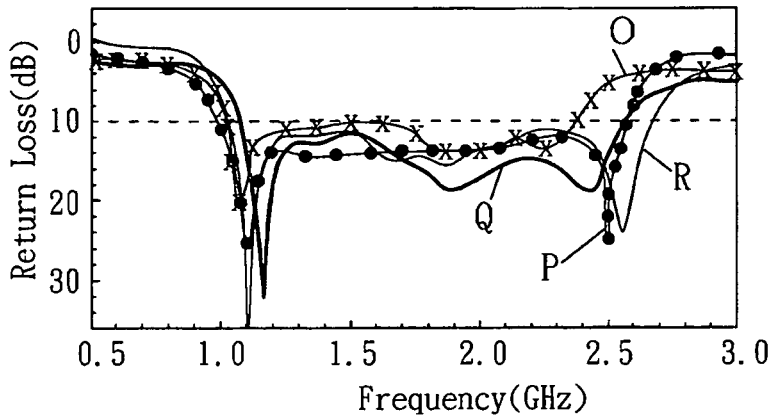
FIG. 6A depicts the curves of the simulated and measured return losses against frequency for the broadband circularly polarized annular ring slot antennas, according to the third and the fourth embodiments of the present invention.
Figure 6B:
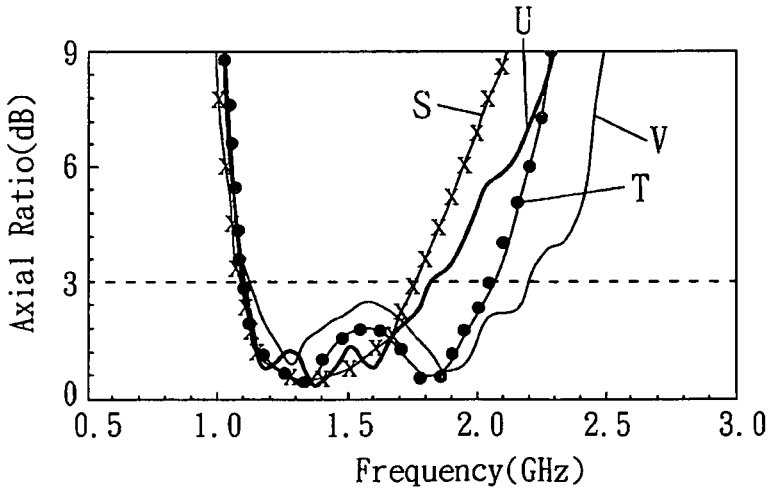
FIG. 6B depicts the curves of the simulated and measured axial ratios against frequency for the broadband circularly polarized annular ring slot antennas, according to the third and the fourth embodiments of the present invention.
Figure 6C:
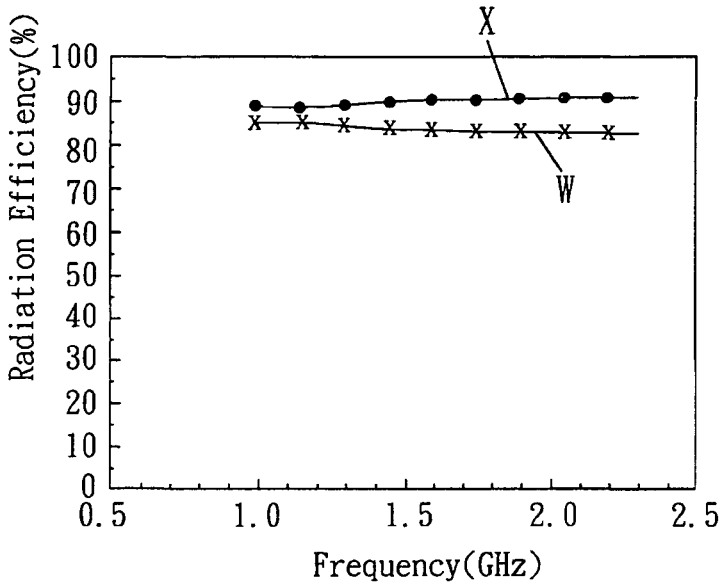
FIG. 6C depicts the curves of the simulated radiation efficiencies against frequency for the broadband circularly polarized annular ring slot antennas, according to the third and the fourth embodiments of the present invention.
Figure 6D:
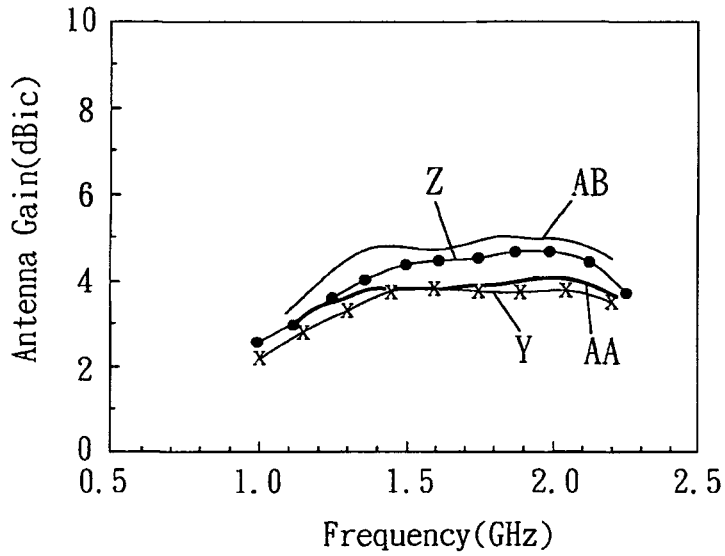
FIG. 6D depicts the curves of the simulated and measured antenna gains against frequency for the broadband circularly polarized annular ring slot antennas, according to the third and the fourth embodiments of the present invention.

Please refer to FIGS. 6A to 6D, wherein FIG. 6A depicts the curves of the simulated and measured return losses against frequency for the broadband circularly polarized annular ring slot antennas, according to the third and the fourth embodiments of the present invention. FIG. 6B depicts the curves of the simulated and measured axial ratios against frequency for the broadband circularly polarized annular ring slot antennas, according to the third and the fourth embodiments of the present invention. FIG. 6C depicts the curves of the simulated radiation efficiencies against frequency for the broadband circularly polarized annular ring slot antennas, according to the third and the fourth embodiments of the present invention. FIG. 6D depicts the curves of the simulated and measured antenna gains against frequency for the broadband circularly polarized annular ring slot antennas, according to the third and the fourth embodiments of the present invention.

The simulation results of the aforementioned FIGS. 6A, 6B, 6C and 6D are all obtained by using the Ansoft High Frequency Structure Simulator. In FIG. 6A, the curves O and P represent the simulated return losses of the broadband circularly polarized annular ring slot antennas according to the third and fourth embodiments of the present invention, respectively. The curves Q and R represent the measured return losses of the broadband circularly polarized annular ring slot antenna according to the third and fourth embodiments of the present invention, respectively.

In FIG. 6B, the curves S and T represent the simulated axial ratios of the broadband circularly polarized annular ring slot antennas according to the third and fourth embodiments of the present invention, respectively. The curves U and V represent the measured axial ratios of the broadband circularly polarized annular ring slot antennas according to the third and fourth embodiments of the present invention, respectively.

In FIG. 6C, the curves W and X represent the simulated radiation efficiencies of the broadband circularly polarized annular ring slot antennas according to the third and fourth embodiments of the present invention, respectively.

In FIG. 6D, the curves Y and Z represent the simulated antenna gains of the broadband circularly polarized annular ring slot antennas according to the third and fourth embodiments of the present invention, respectively. The curves AA and AB represent the measured antenna gains of the broadband circularly polarized annular ring slot antennas according to the third and fourth embodiments of the present invention, respectively.

From FIGS. 6A and 6B, it can be seen that the circularly polarized frequency band of the broadband circularly polarized annular ring slot antenna according to the third embodiment of the present invention is located between 1125 MHz and 1800 MHz, which means that a 3-dB-axial-ratio bandwidth of 46.2% is achieved. Furthermore, the circularly polarized frequency band of the broadband circularly polarized annular ring slot antenna according to the fourth embodiment of the present invention is located between 1100 MHz and 2175 MHz, which means that a 3-dB-axial-ratio bandwidth of 65.6% is achieved.

It can be seen from FIG. 6C that the radiation efficiency of the broadband circularly polarized annular ring slot antenna according to the third embodiment of the present invention is between 82% and 85%, while the radiation efficiency of the broadband circularly polarized annular ring slot antenna according to the fourth embodiment of the present invention is between 88% and 91%.

Besides, as shown in FIG. 6D, the antenna gain of the broadband circularly polarized annular ring slot antenna according to the third embodiment of the present invention is between 2.7 dBic and 4.1 dBic, while the antenna gain of the broadband circularly polarized annular ring slot antenna according to the fourth embodiment of the present invention is between 3.3 dBic and 5.1 dBic.

With reference to FIGS. 6A, 6B, 6C and 6D together, it is known that the broadband circularly polarized annular ring slot antennas according to the third and the fourth embodiments of the present invention not only can be applied in a Global Navigation Satellite System, but also have excellent antenna characteristics, for example, a 3-dB-axial-ratio bandwidth greater than 32%, a radiation efficiency greater than 80% and an antenna gain larger than 2.5 dBic.

In summary, since the annular ring slot antenna portion includes the first perturbation metal unit and the second perturbation metal unit that are implanted in the annular ring slot unit diametrically opposite with respect to the central metal unit, and the microstrip feeding portion includes a bent feeding unit, a vertical feeding unit, and a rectangular microstrip unit connected with both the bent feeding unit and the vertical feeding unit, the 3-dB-axial-ratio bandwidth of the broadband circularly polarized annular ring slot antenna of the present invention is much larger than that of the conventional broadband circularly polarized annular ring slot antenna (larger than 32%). Moreover, by having the existence of the first perturbation metal unit and the second perturbation metal unit, the broadband circularly polarized annular ring slot antenna of the present invention can increase the 3-dB-axial-ratio bandwidth, without the need to enlarge the size. Besides, by properly adjusting the material of the substrate and the size of each component (while the shape and the relative relationship of each component are fixed), the broadband circularly polarized annular ring slot antenna of the present invention can be operated in the frequency range of many L-band Satellite Systems (1~2 GHz). As a result, the broadband circularly polarized annular ring slot antenna of the present invention can be used as the small size transceiver antenna of these Satellite Systems.

Although the present invention has been explained in relation to its preferred embodiment, it is to be understood that many other possible modifications and variations can be made without departing from the spirit and scope of the invention as hereinafter claimed.

What is claimed is:

1. A broadband circularly polarized annular ring slot antenna, comprising:

a substrate, having an upper surface and a lower surface;

an annular ring slot antenna portion, located on the upper surface and including a grounding unit, an annular ring slot unit, a central metal unit, a first perturbation metal unit and a second perturbation metal unit, the annular ring slot unit being surrounded by the grounding unit, the central metal unit being surrounded by the annular ring slot unit; and a microstrip feeding portion, located on the lower surface and including a vertical feeding unit, a bent feeding unit and a rectangular microstrip unit, the rectangular microstrip unit being connected with the bent feeding unit and the vertical feeding unit respectively, the vertical feeding unit being extended from the bent feeding unit toward a side edge of the substrate, the bent feeding unit being extended from the vertical feeding unit toward another side edge of the substrate;

wherein the first perturbation metal unit and the second perturbation metal unit of the annular ring slot antenna portion are extended from the grounding unit toward the central metal unit respectively, and the first perturbation metal unit and the second perturbation metal unit are implanted in the annular ring slot unit diametrically opposite with respect to the central metal unit, and wherein the first perturbation metal unit is composed of a first rectangular patch and a first semi-elliptical patch extended from the first rectangular patch toward the central metal unit, and the second perturbation metal unit is composed of a second rectangular patch and a second semi-elliptical patch extended from the second rectangular patch toward the central metal unit.

2. The broadband circularly polarized annular ring slot antenna as claimed in claim 1, wherein the substrate is a rectangular substrate with a low dielectric constant.

3. The broadband circularly polarized annular ring slot antenna as claimed in claim 1, wherein the grounding unit, the central metal unit, the first perturbation metal unit and the second perturbation metal unit are all thin layer metal films.

4. The broadband circularly polarized annular ring slot antenna as claimed in claim 1, wherein the annular ring slot unit has a shape of annular ring.

5. The broadband circularly polarized annular ring slot antenna as claimed in claim 1, wherein the annular ring slot unit has an outer radius, an inner radius, a slot width and an average radius, the outer radius being larger than the inner radius, the slot width being the difference between the outer radius and the inner radius, the average radius being the average value of the outer radius and the inner radius.

6. The broadband circularly polarized annular ring slot antenna as claimed in claim 5, wherein the slot width of the annular ring slot unit is between 0.36- time and 0.64- time of the average radius of the annular ring slot unit.

7. The broadband circularly polarized annular ring slot antenna as claimed in claim 1, wherein the first perturbation metal unit and the second perturbation metal unit are located on a diagonal line of the substrate respectively, and the angle between the diagonal line and an extending line of the vertical feeding unit is 45 degrees.

* * * * *